US007733031B2

(12) United States Patent
Nerone

(10) Patent No.: US 7,733,031 B2
(45) Date of Patent: Jun. 8, 2010

(54) STARTING FLUORESCENT LAMPS WITH A VOLTAGE FED INVERTER

(75) Inventor: Louis Robert Nerone, Brecksville, OH (US)

(73) Assignee: General Electric Company, Schenectady, NY (US)

( * ) Notice: Subject to any disclaimer, the term of this patent is extended or adjusted under 35 U.S.C. 154(b) by 408 days.

(21) Appl. No.: 11/981,360

(22) Filed: Oct. 31, 2007

(65) Prior Publication Data

US 2009/0108764 A1 Apr. 30, 2009

(51) Int. Cl.
*H05B 39/04* (2006.01)

(52) U.S. Cl. ..... 315/224; 315/209 R; 315/277

(58) Field of Classification Search ..... 315/224, 315/177, 185 R, 186, 189, 209 R, 219, 220, 315/246, 250, 254, 255, 256, 257, 258, 276, 315/277, 278, 279, 287, 291; 361/268, 270, 361/271, 272

See application file for complete search history.

(56) References Cited

U.S. PATENT DOCUMENTS 6,051,934 A 4/2000 Nerone
6,150,769 A 11/2000 Nerone et al.
6,975,076 B2 * 12/2005 Nerone ..... 315/209 R
2003/0090217 A1 5/2003 Nerone
2003/0094907 A1 5/2003 Nerone
2007/0176564 A1 8/2007 Nerone et al.

FOREIGN PATENT DOCUMENTS

EP 0 828 408 A2 3/1998

OTHER PUBLICATIONS

PCT/US2008/073546 International Search Report, mailed Nov. 21, 2008.

* cited by examiner

*Primary Examiner*—Douglas W Owens
*Assistant Examiner*—Jianzi Chen
(74) *Attorney, Agent, or Firm*—Fay Sharpe LLP

(57) ABSTRACT

A lamp ballast includes an inverter circuit, a resonant circuit, a control circuit, and a startup circuit. When the DC bus reaches its final value, a capacitor in the startup circuit charges to a predetermined voltage, at which point a pulse is sent to start a gate drive circuit in the inverter. Additionally, a gate in the control circuit is initially OFF, allowing full power to the lamp, and a capacitor in the control circuit charges to a predetermined voltage, at which point a gate is turned ON. When the gate is ON, power to the lamp is reduced. The control circuit capacitor is selected so that it charges for a sufficient period to allow the lamp to complete a glow phase of startup before turning on the gate and reducing power as the lamp transitions into an arc phase.

20 Claims, 4 Drawing Sheets

STARTING FLUORESCENT LAMPS WITH A VOLTAGE FED INVERTER

BACKGROUND OF THE INVENTION

The present application is directed to electronic ballasts. It finds particular application in conjunction with the fluorescent lamps and will be described with the particular reference thereto.

A ballast is an electrical device which is used to provide power to a load, such as an electrical lamp, and to regulate the current provided to the load. The ballast provides high voltage to start a lamp by ionizing sufficient plasma (vapor) for the arc to be sustained and to grow. Once the arc is established, the ballast allows the lamp to continue to operate by providing proper controlled current flow to the lamp.

Typically, after the alternating current (AC) voltage from the power source is rectified and appropriately conditioned, the inverter converts the DC voltage to AC. The inverter typically includes a pair of serially connected switches, such as MOSFETs which are controlled by the drive gate control circuitry to be "ON" or "OFF."

In conventional voltage fed designs, the inverter does not boost the power applied to the lamps during the glow-arc transition, causing this transition to be slower than desired. Additionally, different sizes and/or lengths of lamps translate into different current requirements, which in turn require conventional inverters to limit the amount of power provided to the lamp terminals.

The following contemplates new methods and apparatuses that overcome the above referenced problems and others.

BRIEF DESCRIPTION OF THE INVENTION

According to an aspect, a lamp ballast comprises a resonant circuit with a high-frequency bus coupled to at least one lamp, a control circuit coupled to the high-frequency bus, and an inverter circuit with first and second gate drive circuits that generate a waveform input for the resonant circuit. The ballast further comprises a bias voltage supply that supplies voltage to a power factor correction (PFC) circuit coupled to the ballast, and a startup circuit, coupled to the second gate drive circuit by a switch, and having a first capacitor that is charged by the PFC circuit during startup. The second gate drive circuit is turned on when the first capacitor reaches a predetermined threshold voltage, causing the switch to send a pulse to the second gate drive circuit.

According to another aspect, a startup system for a fluorescent lamp ballast comprises a voltage-fed inverter circuit having first and second gate drive circuits, a bias voltage supply, and a resonant circuit, coupled to the inverter circuit and to at least one fluorescent lamp. The startup system further comprises a control circuit that is coupled to the inverter circuit and the resonant circuit, and a startup circuit that is hardwired to the inverter circuit, with a first capacitor that charges when the bias voltage supply supplies voltage to the startup circuit through the PFC circuit.

According to yet another aspect, a startup circuit comprises a diode with an anode connected to a positive terminal and a cathode connected to a first node; a capacitor connected to the first node, and a second node; a first resistor connected in parallel with the capacitor; and a second resistor connected to the first node and to a switch. The second node is coupled to a negative terminal and to ground, and the startup circuit sends a pulse, via the switch, to start a gate drive circuit.

DETAILED DESCRIPTION OF THE INVENTION

Figure 1:
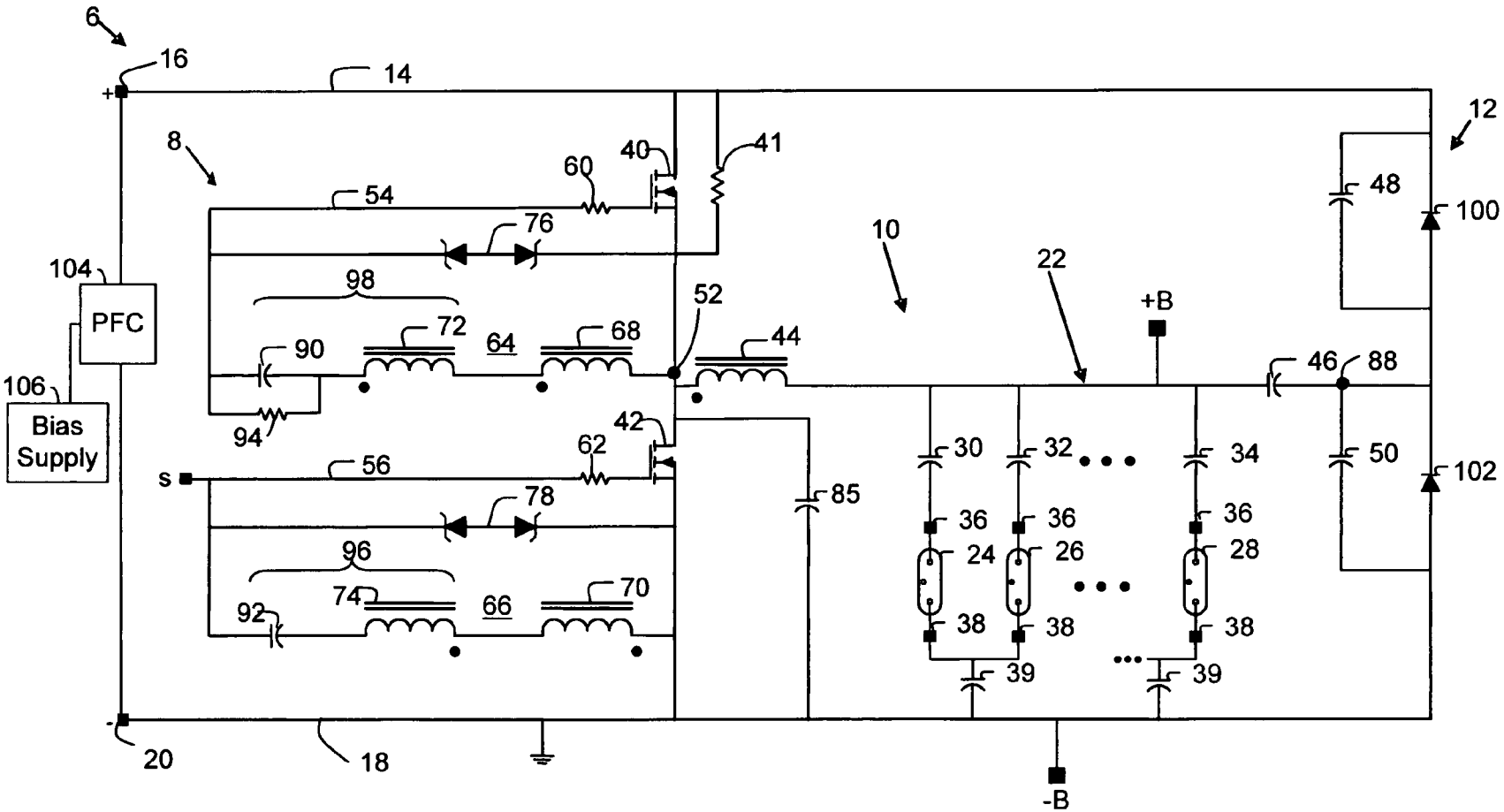
FIG. 1 illustrates a ballast circuit that employs a voltage fed inverter to increase power to one or more lamps during a glow phase during startup, and then decrease power during an arc phase of startup.

With reference to FIG. 1, a ballast circuit 6 is illustrated, which employs a voltage fed inverter to increase power to one or more lamps during a glow phase during startup, and then decrease power during an arc phase of startup. The ballast circuit 6 includes an inverter circuit 8, a resonant circuit or network 10, and a clamping circuit 12. A DC voltage is supplied to the inverter 8 via a voltage conductor 14 running from a positive voltage terminal 16 and a common conductor 18 connected to a ground or common terminal 20. A high frequency bus 22 is generated by the resonant circuit 10 as described in more detail below. Additionally, the high-frequency bus 22 is connected to a node, labeled "+B," which in turn is connected to a controller circuit 108, described in greater detail below. First, second, . . . , nth lamps 24, 26, . . . , 28 are coupled to the high frequency bus via first, second, . . . , nth ballasting capacitors 30, 32, . . . , 34. Thus if one lamp is removed, the others continue to operate. It is contemplated that any number of lamps can be connected to the high frequency bus 22. E.g., each lamp 24, 26, . . . , 28 is coupled to the high frequency bus 22 via an associated ballasting capacitor 30, 32, . . . , 34. Power to each lamp 24, 26, . . . , 28 is supplied via respective lamp connectors 36, 38. Lamp connectors 38 are connected pairwise to respective blocking capacitors 39.

The inverter 8 includes analogous upper and lower or first and second switches 40 and 42, for example, two n-channel MOSFET devices (as shown), connected between conductors 14 and 18, to excite the resonant circuit 10. Two p-channel MOSFETs may alternatively be configured. A resistor 41 is connected in parallel with the first switch 40. The high frequency bus 22 is generated by the inverter 8 and the resonant circuit 10 and includes a resonant inductor 44 and an equivalent resonant capacitance which includes the equivalence of first, second and third capacitors 46, 48, 50, and ballasting capacitors 30, 32, . . . , 34, which also prevent DC current flowing through the lamps 24, 26, . . . , 28. The ballasting capacitors 30, 32 . . . , 34 are primarily used as ballasting capacitors.

The switches 40 and 42 cooperate to provide a square wave at a common or first node 52 to excite the resonant circuit 10. Gate or control lines 54 and 56 run from the switches 40 and 42. Each control line 54, 56 includes a respective resistance 60, 62.

With continuing reference to FIG. 1, first and second gate drive circuitry or circuit, generally designated 64, 66, is connected to first and second switches 40 and 42, respectively, and includes first and second driving inductors 68, 70 which are secondary windings mutually coupled to the resonant inductor 44 to induce in the driving inductors 68, 70 voltage proportional to the instantaneous rate of change of current in the resonant circuit 10. First and second secondary inductors 72, 74 are serially connected to the respective first and second driving inductors 68, 70 and the gate control lines 54 and 56.

The gate drive circuitry 64, 66 is used to control the operation of the respective upper and lower switches 40 and 42. More particularly, the gate drive circuitry 64, 66 maintains the upper switch 40 "OFF" for a first half of a cycle, and the lower switch 42 "OFF" for a second half of the cycle. The square wave is generated at the node 52 and is used to excite the resonant circuit 10. First and second bi-directional voltage clamps 76, 78 are connected in parallel to the secondary inductors 72, 74 respectively, each including a pair of back-to-back Zener diodes. The bi-directional voltage clamps 76, 78 act to clamp positive and negative excursions of gate-to-source voltage to respective limits determined by the voltage ratings of the back-to-back Zener diodes. Each bi-directional voltage clamp 76, 78 cooperates with the respective first or second secondary inductor 72, 74 so that the phase angle between the fundamental frequency component of voltage across the resonant circuit 10 and the AC current in the resonant inductor 44 approaches zero during ignition of the lamps.

A capacitor 85, connected between the common node 52 and the common conductor 18, acts as a snubber capacitor to allow switches 40 and 42 to switch on and off when their D-S terminals are at zero volts. Upper and lower capacitors 90, 92 are connected in series with the respective first and second secondary mutually coupled inductors 72, 74. In the starting process, the capacitor 92 is charged from the voltage terminal 16, while a resistor 94 shunts the capacitor 90 to prevent the capacitor 90 from charging. This prevents the switches 40 and 42 from turning ON, initially, at the same time. The voltage across the capacitor 92 is initially zero, and, during the starting process, the serially-connected inductors 70 and 74 act essentially as a short circuit, due to a relatively long time constant for charging of the capacitor 92. When the capacitor 92 is charged to the threshold voltage of the gate-to-source voltage of the switch 42, (e.g., 2-3 volts), the switch 42 turns ON, which results in a small bias current flowing through the switch 42. The resulting current biases the switch 42 in a common drain, Class A amplifier configuration. This produces an amplifier of sufficient gain such that the combination of the resonant circuit 10 and the gate control circuit 66 produces a regenerative action which starts the inverter into oscillation, near the resonant frequency of the network including the capacitor 92 and inductor 74. The generated frequency is above the resonant frequency of the resonant circuit 10, which allows the inverter 8 to operative above the resonant frequency of the resonant network 10. This produces a resonant current which lags the fundamental of the voltage produced at the common node 52, allowing the inverter 8 to operate in the soft-switching mode prior to igniting the lamps. Thus, the inverter 8 starts operating in the linear mode and transitions into the switching Class D mode. Then, as the current builds up through the resonant circuit 10, the voltage of the high frequency bus 22 increases to ignite the lamps, while maintaining the soft-switching mode, through ignition and into the conducting, arc mode of the lamps.

During steady state operation of the ballast circuit 6, the voltage at the common node 52, being a square wave, is approximately one-half of the voltage of the positive terminal 16. The bias voltage that once existed on the capacitor 92 diminishes. The frequency of operation is such that a first network 96 including the capacitor 92 and inductor 74 and a second network 98 including the capacitor 90 and inductor 72 are equivalently inductive. That is, the frequency of operation is above the resonant frequency of the identical first and second networks 96, 98. This results in the proper phase shift of the gate circuit to allow the current flowing through the inductor 44 to lag the fundamental frequency of the voltage produced at the common node 52. Thus, soft-switching of the inverter 8 is maintained during the steady-state operation.

With continuing reference to FIG. 1, the output voltage of the inverter 8 is clamped by serially connected clamping diodes 100, 102 of the clamping circuit 12 to limit high voltage generated to start the lamps 24, 26, . . . , 28. The clamping circuit 12 further includes the second and third capacitors 48, 50, which are essentially connected in parallel to each other. Each clamping diode 100, 102 is connected across an associated second or third capacitor 48, 50. Prior to the lamps starting, the lamps' circuits are open, since impedance of each lamp 24, 26, . . . , 28 is seen as very high impedance. The resonant circuit 10 is composed of the capacitors 46, 48, 50 and the resonant inductor 44 and is driven near resonance. As the output voltage at the common node 52 increases, the clamping diodes 100, 102 start to clamp, preventing the voltage across the second and third capacitors 48, 50 from changing sign and limiting the output voltage to the value that does not cause overheating of the inverter 8 components. When the lamps ignite, the impedance decreases quickly. Capacitors 30, 32, . . . , 34 and 39 now become additional components of the resonant circuit. The arc resistances of the lamps load the resonant circuit. The voltage at the bus 22 decreases accordingly. The clamping diodes 100, 102 discontinue clamping the second and third capacitors 48, 50 and the ballast 6 enters steady state operation. The resonance is dictated by the capacitors 30, 32, . . . , 34, 46, 48, 50 and the resonant inductor 44. Capacitors 39 have a minor contribution to the resonant circuit because their values are chosen to be much higher than capacitors 30, 32, . . . , 34.

In the manner described above, the inverter 8 provides a high frequency bus 22 while maintaining the soft switching condition for switches 40, 42. The inverter 8 is able start a single lamp when the rest of the lamps are lit because there is sufficient voltage at the high frequency bus to allow for ignition.

The circuit 6 additionally includes power factor correction (PFC) circuitry 104, which is coupled to a bias voltage supply 106. The bias supply 106 turns on the PFC circuitry 104, increases voltage to a capacitor 174 (described below with regard to FIG. 4), which charges and then sends a pulse to the low-side switch 42 of the inverter 8, which causes the inverter 8 to turn on.

Figure 2:
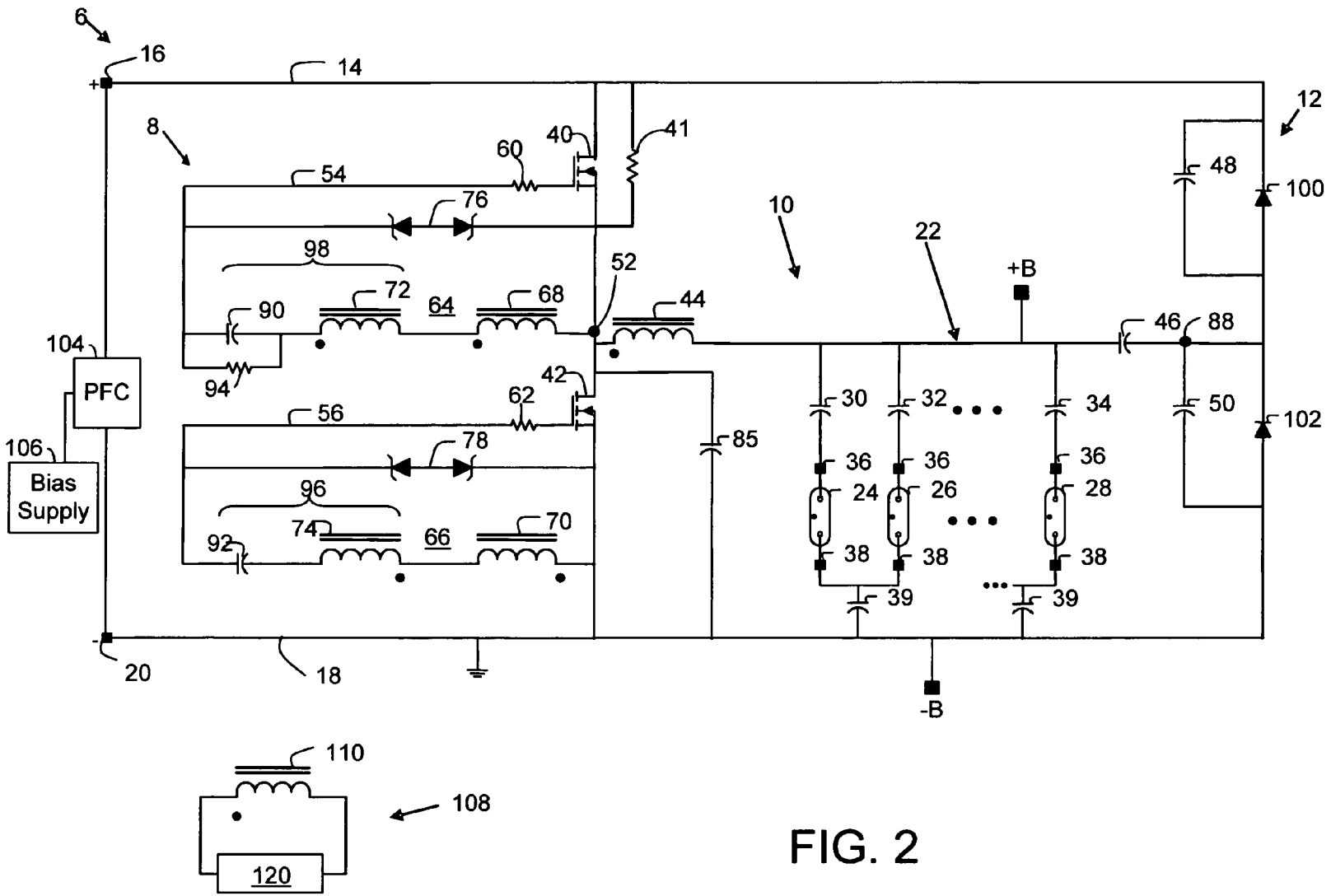
FIGS. 2 and 3 illustrate a control circuit coupled to the inverter circuit.
Figure 3:
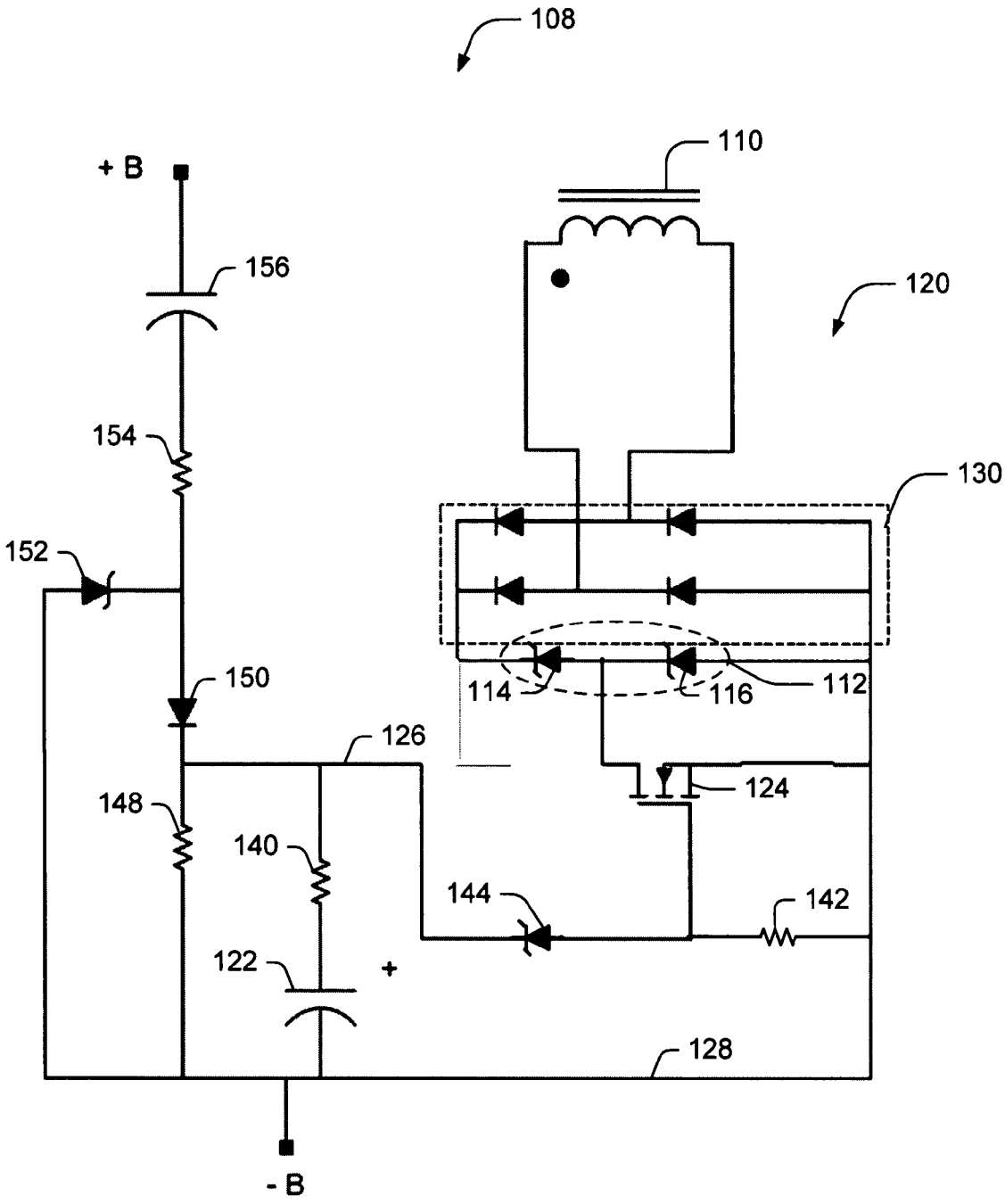

With reference to FIGS. 2 and 3, a tertiary circuit 108 is coupled to the inverter circuit 8. More specifically, a tertiary winding or inductor 110 is mutually coupled to the first and second secondary inductors 72, 74, and the circuit 108 is hardwired to the ballast circuit 6 via node +B. Additionally, FIGS. 1-3 include a node "−B," which can be a ground. In this embodiment, the first and second bi-directional voltage clamps 76, 78 are optionally omitted. An auxiliary or third voltage clamp 112, which includes first and second Zener diodes 114, 116, is connected in parallel to the tertiary inductor 110. Because the tertiary inductor 110 is mutually coupled to the first and second secondary inductors 72, 74, the auxiliary voltage clamp 112 simultaneously clamps the first and second gate circuits 64, 66.

Different values of the Zener diodes 114, 116 of the voltage clamp 112 are useful in allowing the ballast 6 to change the current and subsequently the power provided to the lamps 24, 26, . . . , 28. In an instant-start ballast, the initial mode of the lamp operation is glow. In the glow mode, the voltage across the lamp electrodes is high, for example, 300V. The current which flows in the lamp is typically lower than the running current, for example, 40 or 50 mA instead of 180 mA. The electrodes heat up and become thermionic. Once the electrodes become thermionic, the electrodes emit electrons into the plasma and the lamp ignites.

For example, during ignition of the lamps 24, 26, . . . , 28, the clamping voltage of the tertiary winding 110 is increased to allow more glow power. After the lamps have started, the voltage can be folded back to allow the rated steady-state current to flow. This function can be implemented via a controller 120.

More specifically, prior to ignition, a capacitor 122 is discharged, causing a switch 124, such as a MOSFET, to be in the "OFF" state. When the inverter 8 starts to oscillate, the capacitor 122 charges via lines 126 and 128, which couple to a full-wave bridge rectifier. The tertiary winding 110 is clamped by serially connected first and second Zener diodes 114, 116, which are coupled to the drain and source of the MOSFET 124. When the capacitor 122 charges to the threshold voltage of the MOSFET 124, the MOSFET 124 turns ON, shunting current away from the second Zener diode 116 that is connected across the drain and source terminals of the MOSFET 124, and the control circuit to start regulating. Since the capacitor 122 is connected in series with a resistor 140, it takes time for the capacitor to charge to the threshold voltage of the MOSFET 124. A resistor 142 is connected to the gate and source of the MOSFET 124. A third Zener diode 144 is connected to the gate of the MOSFET 124 and to the output line 126. A resistor 148 is connected in parallel to the resistor 140 and capacitor 122. Thus, the higher voltage clamping of the tertiary winding 110 allows more glow power to be achieved until the lamps 24, 26, . . . , 28 start. The circuit 108 further includes a diode 150, a fourth Zener diode 152, a resistor 154, and a capacitor 156, which is connected to node +B (e.g., the tie-in point to high-frequency bus 22 of the ballast circuit 6).

After a period of time, such as for example from about 0.5 to about 1.0 seconds, the MOSFET 124 turns ON, causing the tertiary winding 110 to be clamped at a lower voltage. This allows the lower steady-state lamp power to be achieved. Thus, the switching of the clamping voltage, such as the switching of the voltage clamping of the tertiary winding 110 via the Zener diodes 114, 116, causes an increase in the power applied to the lamps 24, 26, . . . , 28 during the glow stage but folds back this power to allow the lamps 24, 26, . . . , 28 to operate under normal predetermined power levels of the lamps 24, 26, . . . , 28.

Figure 4:
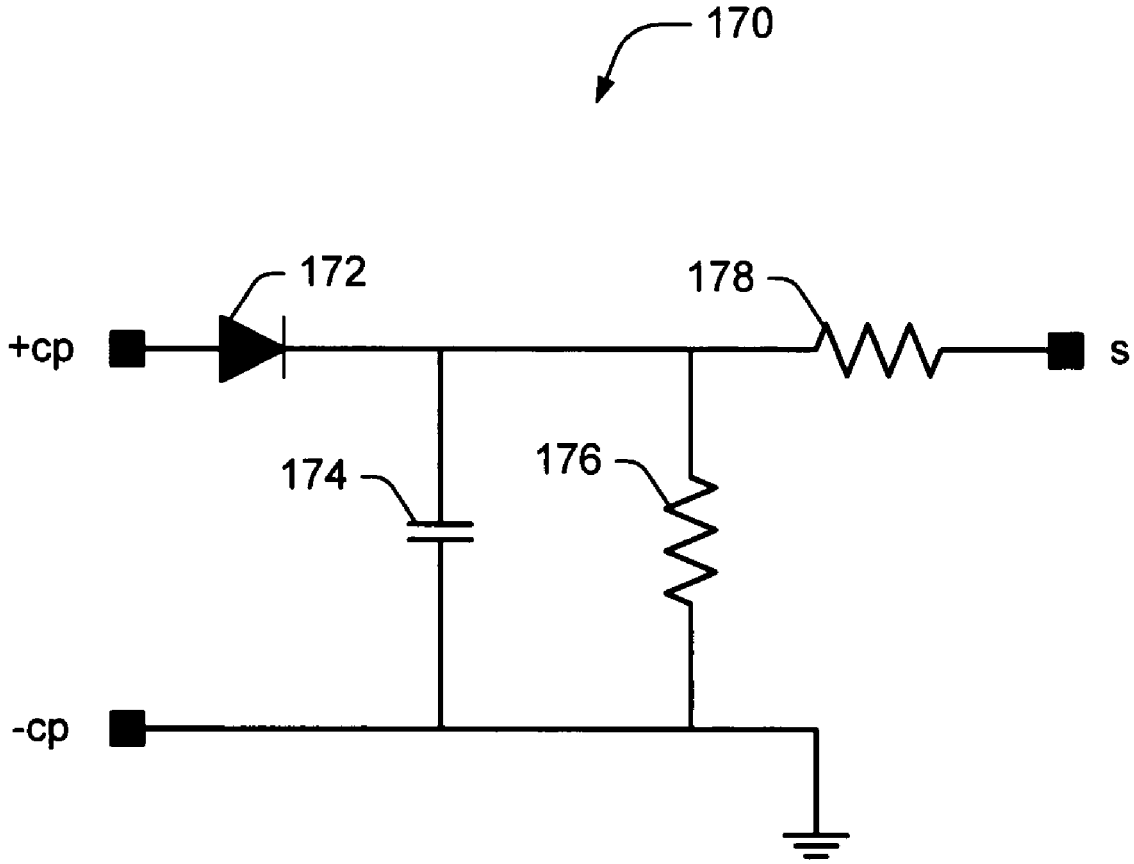
FIG. 4 illustrates a startup circuit that facilitates enhancing a glow-to-arc transition of a fluorescent lamp using a voltage-fed inverter topology.

FIG. 4 illustrates a startup circuit 170 that facilitates enhancing a glow-to-arc transition of a fluorescent lamp using a voltage-fed inverter topology, as described in FIG. 1. The startup circuit allows the inverter to deliver maximum power to the lamps during a glow phase, and then fold back to a desired power level as the lamp transitions into arc mode. The startup circuit regulates inverter output for a variety of lamp types (e.g., F28, F30, F32, etc.).

The startup circuit 172 comprises a diode 170 that is coupled to a positive node, cp+, and to each of a capacitor 174, a resistor 176, and a resistor 178. The other end of the resistor 178 is coupled to a switch "s," which ties into the second gate drive circuit 66 of FIG. 1. The other ends of capacitor 174 and resistor 176 are coupled to a negative terminal, cp−. When the bias supply 106 (FIG. 1) turns on the PFC circuitry 104 (FIG. 1), voltage to the capacitor 174 is increased, causing the capacitor 174 to charge and then send a pulse to the low-side switch 42 of the inverter 8 (FIG. 1), which causes the inverter 8 to turn on. By allowing the DC bus 14 to reach its final value, the startup circuit 170 facilitates increasing the speed of the glow-to-arc transition for a variety of lamps.

According to an example, output power to the lamps is regulated by loading the ancillary winding 110. The full-wave bridge rectifier 130 rectifies the voltage from the winding 110 and loads the transformer via Zener diodes 114, and 116, and via MOSFET 124. During startup, MOSFET 124 is OFF, causing Zener diodes 114 and 116 to conduct and allowing the inverter 8 to deliver maximum power to the lamps before they transition into full arc mode. Capacitor 122 charges via capacitor 156, resistor 154, resistor 148, diode 150 and Zener diode 152 until it surpasses the Zener voltage of Zener diode 144. As the threshold of MOSFET 124 is exceeded, the MOSFET 124 turns ON, shunting Zener diode 116, and thereby clamping the ancillary winding 110, which lowers the power delivered to the lamps. The time required to turn on MOSFET 124 determines how long the inverter 8 is operated in the higher-power state, and can be set to, for instance, approximately 500 ms to ensure that the lamps transition from glow to arc. Thus, the voltage-fed inverter can operate in manner that mimics a current-fed inverter while the lamp transitions from glow to arc, while giving the efficiency, crest factor, and higher operating frequency advantages associated with the voltage-fed topology described in FIG. 1.

It is to be appreciated that the foregoing example(s) is/are provided for illustrative purposes and that the subject innovation is not limited to the specific values or ranges of values presented therein. Rather, the subject innovation may employ or otherwise comprise any suitable values or ranges of values, as will be appreciated by those of skill in the art.

The invention has been described with reference to the preferred embodiments. Obviously, modifications and alterations will occur to others upon reading and understanding the preceding detailed description. It is intended that the invention be construed as including all such modifications and alterations.

What is claimed is:

1. A lamp ballast, comprising:

a resonant circuit with a high-frequency bus coupled to at least one lamp;

a control circuit, coupled to the high-frequency bus;

an inverter circuit with first and second gate drive circuits that generate a waveform input for the resonant circuit;

a bias voltage supply that supplies voltage to a power factor correction (PFC) circuit coupled to the ballast; and a startup circuit, coupled to the second gate drive circuit by a switch, and having a first capacitor that is charged by the PFC circuit during startup;

wherein the second gate drive circuit is turned on when the first capacitor reaches a predetermined threshold voltage, causing the switch to send a pulse to the second gate drive circuit.

2. The ballast as set forth in claim 1, wherein the inverter circuit delivers maximum power to the at least one lamp during a glow phase of startup, and a predetermined lesser level of power during a transition to an arc phase of startup.

3. The ballast as set forth in claim 2, further including a first resistor, connected in a parallel with a first gate drive capacitor in the first gate drive circuit, wherein the first resistor shunts current from the first gate drive capacitor while the second gate drive circuit is in the ON state.

4. The ballast as set forth in claim 3, wherein the first gate drive capacitor charges at a slower rate than a second gate drive capacitor in the second gate drive circuit, causing the first gate drive circuit to remain in an OFF state until the first gate drive capacitor reaches its maximum voltage.

5. The ballast as set forth in claim 4, wherein the first gate drive turns ON, and the second gate drive circuit turns OFF when the first gate drive capacitor reaches its maximum voltage.

6. The ballast as set forth in claim 1, wherein the second gate drive circuit is in an ON state upon receiving the pulse via the switch.

7. The ballast as set forth in claim 1, further comprising a first transformer with a primary winding in the first gate drive circuit, a secondary winding in the second gate drive circuit, and a tertiary winding in the resonant circuit.

8. The ballast as set forth in claim 7, further comprising a second transformer with a primary winding in the first gate drive circuit, a secondary winding in the second gate drive circuit, and a tertiary winding in the control circuit.

9. The ballast as set forth in claim 8, wherein the control circuit further comprises a gate that is initially in an OFF state, and a diode clamp that conducts current, thereby providing maximum current to the at least one lamp during a glow phase of startup.

10. The ballast as set forth in claim 9, wherein the control circuit further comprises a capacitor that charges until it surpasses a Zener voltage of a Zener diode coupled to the gate, at which point the gate turns on and the tertiary winding of the second transformer is clamped, thereby reducing power to the at least one lamp during transition into an arc phase of startup.

11. The ballast as set forth in claim 9, wherein the gate is a MOSFET.

12. The ballast of claim 1, wherein the one or more lamps is a linear fluorescent lamp.

13. A startup system for a fluorescent lamp ballast, comprising:

a voltage-fed inverter circuit having first and second gate drive circuits, and a bias voltage supply;

a resonant circuit, coupled to the inverter circuit and to at least one fluorescent lamp;

a control circuit that is coupled to the inverter circuit and the resonant circuit; and a startup circuit, hardwired to the inverter circuit, with a first capacitor that charges when the bias voltage supply supplies voltage to the startup circuit through a PFC circuit.

14. The system as set forth in claim 13, wherein the startup circuit supplies a pulse to the second gate drive circuit when the first capacitor reaches a predetermined voltage level.

15. The system as set forth in claim 14, wherein the control circuit regulates inverter output power to supply maximum power to the resonant circuit when the lamp is in a glow phase of startup and a lesser amount of power during when the at least one fluorescent lamp transitions to an arc phase of startup.

16. The system as set forth in claim 15, wherein the control circuit includes a MOSFET that is in an OFF state during the glow phase of startup, and a second capacitor that charges during the glow phase of startup.

17. The system as set forth in claim 16, wherein the second capacitor is selected to have a charging period of a predetermined duration to allow the lamp to complete the glow phase and transition into the arc phase, and wherein the MOSFET turns ON when the second capacitor exceeds the Zener voltage of a Zener diode coupled to the second capacitor and the MOSFET.

18. The system as set forth in claim 17, wherein the MOSFET, in the ON state, causes a winding that inductively couples the control circuit to the resonant circuit to beclamped, thereby reducing power to the at least one fluorescent lamp during the transition to the arc phase of startup.

19. A startup circuit, comprising:

a diode with an anode connected to a positive terminal and a cathode connected to a first node;

a capacitor connected to the first node, and a second node;

a first resistor connected in parallel with the capacitor; and a second resistor connected to the first node and to a switch;

wherein the second node is coupled to a negative terminal and to ground; and wherein the startup circuit sends a pulse, via the switch, to start a gate drive circuit.

20. The startup circuit of claim 19, wherein the capacitor charges when power is supplied to it from a bias voltage supply through a power factor correction circuit, and wherein the startup circuit sends the pulse when the capacitor reaches a predetermined threshold voltage.

* * * * *